United States Patent [19]

Talley

[11] 4,199,653

[45] Apr. 22, 1980

[54] TERMINATION FOR ALTERNATE POLARITY RESISTANCE WELDING CABLE

[75] Inventor: Lawrence M. Talley, Bay Village, Ohio

[73] Assignee: Watteredge-Uniflex, Inc., Avon Lake, Ohio

[21] Appl. No.: 914,581

[22] Filed: Jun. 14, 1978

[51] Int. Cl.[2] ..... H01R 11/10

[52] U.S. Cl. ..... 174/15 WF; 174/74 R

[58] Field of Search ..... 174/15 WF, 19, 74 R, 174/75 R

[56] References Cited

U.S. PATENT DOCUMENTS

| | | | |
|---|---|---|---|
| 2,437,747 | 3/1948 | Kuhn et al. | 174/75 R |
| 3,456,064 | 7/1969 | Toto | 174/19 X |
| 4,018,976 | 4/1977 | Grove | 174/15 WF X |

*Primary Examiner*—Roy N. Envall, Jr.
*Attorney, Agent, or Firm*—Maky, Renner, Otto & Boisselle

[57] ABSTRACT

A cable termination assembly for a kickless welding cable of the type comprised of a pair of opposite polarity mutually insulated lugs each having connected thereto a plurality of conductors which are helically and alternately wound is characterized by a terminal including a pair of mutually insulated terminal lug elements each having an offset extension with opposed recessed contact surfaces and cable conductor connectors secured to the terminal ends of the cable conductors, each connector having a contact surface for engagement with one of the recessed contact surfaces of the terminal lug elements, the relative configurations and orientations of the connectors and terminal elements when fastened together being such that the cable conductors at their terminal ends are substantially straight and parallel, and extend in alignment with their respective relative positions in which they are located in the cable adjacent the terminal ends. Thus, the cable conductors of opposite leads are commonly connected to respective terminal elements without bending, twisting and/or crossover of the conductors, thereby substantially reducing bending strains and reactance forces in the cable.

30 Claims, 5 Drawing Figures

TERMINATION FOR ALTERNATE POLARITY RESISTANCE WELDING CABLE

BACKGROUND

This invention relates generally to cable terminations, and more particularly to a cable terminal assembly for flexible, duel-lead conductor cables of the "kickless" or low reactance level type.

Flexible, dual-lead conductor cables of the "kickless" or low reactance level type are well known in the art and are commonly employed as welding cables for connecting welding heads or guns to transformers providing current for resistance welding operations. Such cables are employed to reduce or eliminate the violent jerks or kicks resulting from the reaction of opposite polarity conductors to one another when high currents are impressed on the cable. Generally, these cables each comprise two leads or groups of multiple strand conductors which are alternately circumferentially disposed and helically wound along the cable length. The ends of the cables are secured to terminals for subsequent connection to the welding heads or transformers. Provisions may be made for fluid coolng of the welding cable assembly.

Although such cables successfully have eliminated or substantially reduced the problem of cable "kick", additional problems stem from the connection of the conductors of the same lead to respective terminal lug halves for subsequent connection to the welding heads and transformers. Substantially all mechanical failures in service occur in this part of the welding cable assembly. This problem is one for which many solutions have been sought as seen in the following U.S. Pat. Nos. 2,308,673; 2,702,311; 2,943,133; 3,127,467; 3,143,593; 3,163,704; 3,456,064; and 3,467,767. It therefore has been long recognized that the manner in which cable conductors are connected to the terminal is of major importance in obtaining substantial service life in view of the severe service requirements imposed on welding cables.

It is common manufacturing practice to join together the cable conductors of each cable lead and secure the same to respective, mutually insulated terminal halves or lugs by soldering, clamping or employing detachable cable conductor connectors. The conductors of the same lead usually are bent and/or twisted to obtain the proper alignment of the same for attachment to the respective terminal halves. Each multiple strand cable conductor consists of a large number of fine wires which are strained by such bending and/or twisting and their susceptibility to work-hardening or embrittlement during use is substantially increased thereby leading to premature fracturing of the wires and early failure of the cable assembly. This condition is aggravated further by the high temperatures generally encountered during welding when the cable is carrying high current.

In addition, strands of opposite polarity cross over each other at the termination creating wear points that can cause electrical short circuits. Moreover, because of this cross-over, the alternately disposed relationship of the conductors of opposite leads is disturbed, particularly at the critical failure area, thus inducing a physical reaction between the conductors in this area thereby further contributing to early deterioration of the cable.

In an early attempt to overcome the above-noted problems in welding cable assemblies, Botterhill disclosed in his U.S. Pat. No. 2,702,311 a cable terminal assembly for six conductor strand "kickless" cables comprising two three-way apertured and longitudinally spaced-apart extensions at the inner or rear ends of the mutually insulated terminal halves of a split cylindrical terminal. The rearwardmost extension of one of the terminal halves is longitudinally spaced from the forwardmost extension of the other terminal half by a neck which is received in an enlarged slot in the forwardmost extension in concentric and interlocking fashion, and the respective apertures of the two extensions are positioned alternately relative to each other when viewed from the rear end of the terminal whereby the apertures of both extensions are aligned respectively with the conductors of the cable. The ends of the conductors are then inserted into and soldered in place in the corresponding apertures of the terminal in order to achieve conductivity through the joint and to secure the cable to the terminal. Although the cable terminal assembly of this type eliminates the before mentioned residual stresses in the cable at the critical failure area and maintains the conductor strands alternately disposed, such cable terminal assembly is subject to several shortcomings. For example, the terminal halves are of complicated structure and therefore expensive to manufacture and difficult mutually to insulate. In addition, the heat generated during the soldering process may embrittle the conductor strand wires contributing to their early fracture and thus early failure of the cable. Moreover, when the conductor strands become broken or burned, repair and/or replacement of the damaged conductors is a difficult procedure and usually must be done at the cable manufacturer's facility resulting in costly repair and freight charges.

In a later attempt to overcome the noted problems, Toto in his U.S. Pat. No. 3,456,064 disclosed a cable termination assembly for a four conductor cable comprising a tubular cable conductor connector adapted to be connected to one of the terminal halves of a split terminal which is so orientated by suitably twisting its cable conductor receiving end such that it is aligned with the helix or lay of two of the conductors of the same cable lead. The remaining two conductors of the other cable lead are either separately secured to the other terminal half by separate connectors having a squared forward end and a diverging rear end which is also orientated with the lay of the respective individual conductors, or jointly secured by a single connector which is formed to include a U-shape channel which straddles the twisted connector. Although such cable termination assembly appears to reduce the residual stresses at the connection between the cable and terminal body, the copper strands are severely distorted by the twisting of the conductor terminal, and furthermore, the assembly proces is difficult and time consuming requiring complex dies for swaging the connectors to the desired shape. Moreover, there is no teaching as to how such a cable terminal assembly could effectively be employed with cables having more than four conductors.

SUMMARY OF THE INVENTION

The present invention provides a simplified low cost, easily formed cable terminal assembly which is rugged, electrically efficient and serviceable, and which provides cable conductor terminal connectors and terminal halves of a unique configuration for accomplishing the transition from terminal to cable, wherein the terminal ends of the conductors are allowed to remain substantially straight and in alignment with the position in which the respective conductors are located within the cable. In other words, the terminal ends of the conductors extend longitudinally in parallel relationship, and those of one cable lead are alternately disposed relative to those of the other cable lead substantially completely the longitudinal extent of the cable, whereby there is a consequent reduction in bending strains on the cable at the terminal end and reduction in the physical reaction between adjacent conductors of opposite polarity when current is applied to the cable.

It is therefore a principal object of this invention to provide a cable terminal assembly in which the conductors at their connecting ends remain straight and in alignment with their respective positions in which they are located within the cable.

It is another principal object to provide a cable terminal assembly wherein the collection of the conductors of the same lead for connecting the same to a common terminal element is accomplished by cable conductor terminal connectors and terminal elements of unique relative configurations, and not by bending, twisting and/or cross-over of the conductors.

It is still another principal object to provide terminal connectors for connecting cable conductors of the same lead to a common terminal element in a more economical and efficient manner than now practiced in the art.

A further important object is to provide in such terminal assembly simplified terminal lugs, easy to fabricate, easy mutually to insulate, and facilitating the connection of the cables thereto.

Yet another object is to provide a unique terminal and removable and mechanically attachable conductor terminal connectors for multiple conductor cables of the kickless type.

It is a further object to provide a cable terminal assembly which is substantially free of residual stresses stemming from its assembly.

Another further object is to provide a cable terminal assembly having provision for strain relief of that portion of the cable conductor emerging from the connectors provided therefor.

Still a further object is to provide a cable terminal assembly wherein the alternating relationship of the conductors of opposite leads in "kickless" cables is preserved at the cable to terminal transition thereby to minimize cable "kick" in such region.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DESCRIPTION OF THE PREFERRED EMBODIMENT

Figures 1, 2, 3, 4, 5:
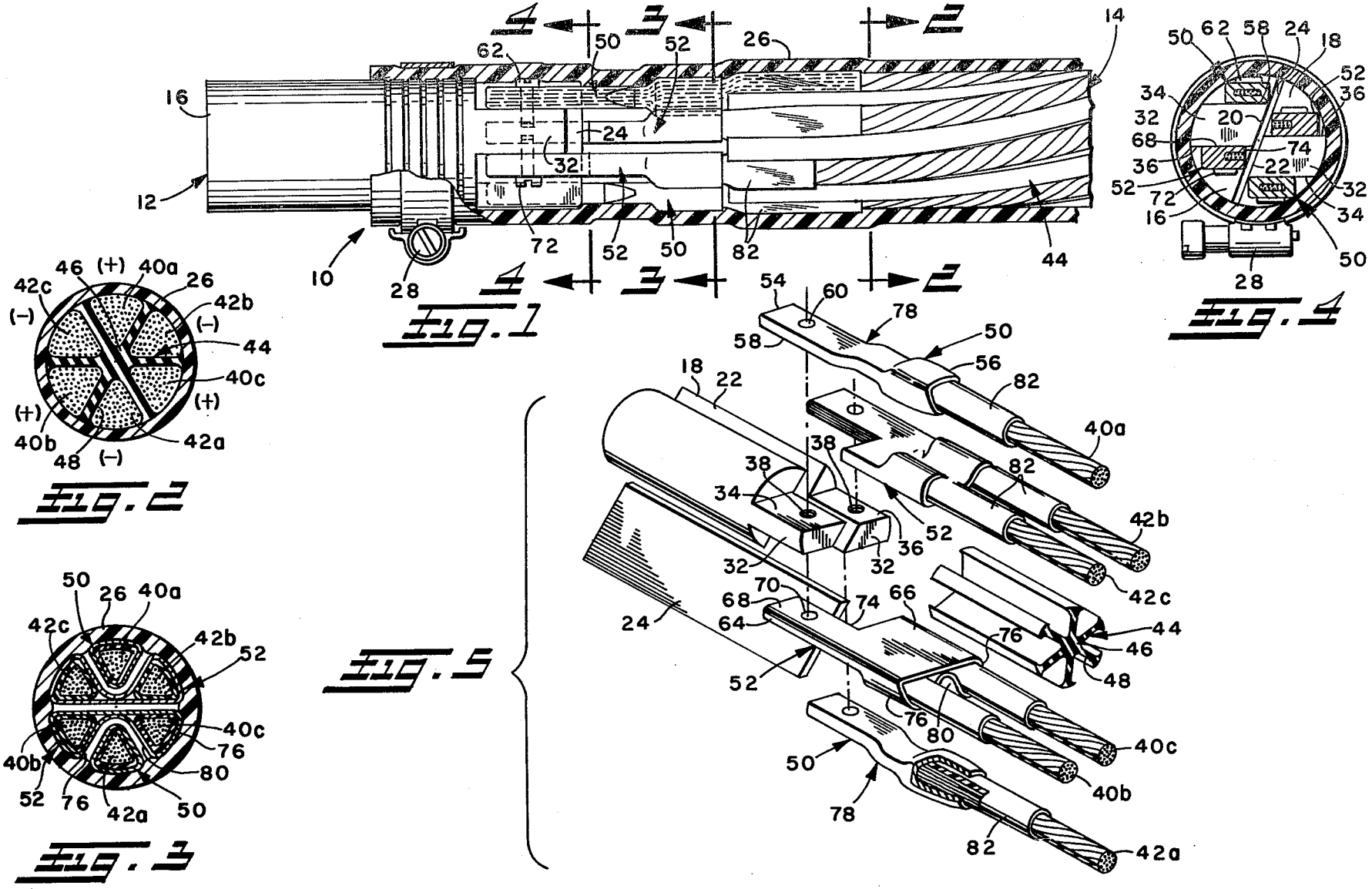
FIG. 1 is a fragmentary longitudinal view, partly in section, of the cable termination assembly of the invention.
FIG. 2 is a transverse section of the assembly of FIG. 1 taken on the line 2—2 thereof.
FIG. 3 is a transverse section of the assembly of FIG. 1 taken on the line 3—3 thereof.
FIG. 4 is a transverse section of the assembly of FIG. 1 taken on the line 4—4 thereof.
FIG. 5 is an exploded perspective view of the assembly illustrated in FIGS. 1–4.

Referring now in greater detail to the drawing, a cable termination assembly constructed in accordance with the present invention is designated generally by reference numeral 10, and comprises a dual polarity terminal 12 and an electrical cable 14 which are described more fully below. Such termination assembly 10 may be employed at both ends of the cable 14 as is typical in a welding cable assembly which is commonly connected between a transformer and welding gun. The principles of the present invention may be employed with a cable assembly having provision for fluid-cooling of the same by passage of a coolant fluid through conduits in the cable assembly; however, the present invention will be described for the sake of clarity for a cable assembly not having such provision, it of course being understood that one skilled in the art could employ the principles of the invention with a fluid-cooled cable assembly.

For purposes of this disclosure, it is to be understood that the term "rearward", when used in connection with the cable termination assembly, refers to the direction generally inwardly of the end or towards the cable and to the right in FIG. 1, and that "forward" is sued to denote the direction generally towards the end or termination and to the left in FIG. 1.

The terminal 12 of the invention is generally of the basic, split cylinder type and comprises a pair of semi-cylindrical, elongated terminal lug elements or halves 16 and 18 essentially identical in shape and joined together along their respective inner flat faces 20 and 22 in non-conductive or insulated relation. A relatively thin, flat insulating plate 24 of rectangular shape disposed between the terminal lug halves 16 and 18 maintains the same electrically insulated from each other. When so spaced by the insulating plate 24, the terminal halves 16 and 18 may be held together against the insulating plate in any suitable manner. As best seen in FIG. 1, an elongate non-conductive, flexible sheath 26, which encases and protects the cable 14, extends around the rearward end of the terminal 12 and is secured thereto by an annular clamp 28 secured thereabout. It can be seen that the sheath and clamp maintain the terminal 12 in the described assembled relationship and maintain the same in a cylindrical shape for receipt in a corresponding cylindrical socket or clamp of a transformer or welding gun or the like. Preferably, a plurality of semi-annular, peripheral grooves 30 are provided in the semi-cylindrical outer surfaces of the terminal halves 16 and 18 at their rearward ends about which the sheath 26 extends to secure mechanically, as well as frictionally, the sheath 26 to the terminal 12, and further to ensure a fluid type seal in the event a fluid-cooled cable is employed.

Although the terminal 12 is shown and described as being of the cylindrical type, it should be understood that the forward portion of the terminal 12 may be formed in any manner to provide for electrical connection to a transformer or welding gun or the like. For example, the forward ends of the terminal halves may be in the form of flat, coextensive projections or lugs generally rectangular in transverse cross-section which have apertures through which a fastener may pass for securing the same to a transformer output lug or welding head lug in well-known manner. An example of this form of terminal can be seen in U.S. Pat. No. 3,456,064.

As best seen in FIGS. 4 and 5, the terminal halves 16 and 18 are essentially of like shape and each at their rearward end is radially recessed inwardly so as to provide a rearwardly projecting extension 32 which is integral with the respective terminal half and includes at opposite sides thereof substantially parallel, flat, longitudinally extending connector receiving surfaces 34 and 36 which are angularly disposed relative to the interfacing planar faces 20 and 22 of the respective terminal halves 16 and 18. The respective extensions are diametrically offset and the parallel circumferentially adjacent faces of opposite extensions are at different radial elevations. Each extension includes one or more fastener receiving apertures 38 which extend transversely therethrough and preferably are threaded for receiving a fastener therein that removably secures a cable conductor terminal connector to the extension in mating assembled relationship in a manner which will be more fully described below.

It should be appreciated that the terminal halves 16 and 18 may be readily formed from a single piece of solid bar stock of conductive metal by cutting the same along an axially extending, diametrical plane, the thickness of the cut being substantially equal that of the insulating plate 24. The rearward ends of the terminal halves may be undercut to provide the extensions 32 with the opposed connector receiving surfaces 34 and 36, the orientation of which is to be more fully described below.

Considering now the cable 14 in detail and referring particularly to FIGS. 1 and 2, the cable 14 comprises two leads or groups 40 and 42 of flexible conductors which are twisted in a helical manner along the cable length with conductors of opposite leads being alternately circumferentially disposed to form a kickless or low reactance level type cable as is well known in the art. For the purpose of the present invention, the cable 14 comprises six conductors of which three conductors, **40*a*, 40*b* and 40*c*, may be considered of positive polarity and three conductors, 42*a*, 42*b* and 42*c*, of negative polarity as indicated generally in FIG. 2. The conductors of opposite polarity or leads are spaced and electrically insulated from one another by an elongate, flexible, insulating member 44 of spur-like cross-section which includes a flexible core 46 and radially extending ribs 48 which extend between and separate the conductors of the respective leads 40 and 42. Accordingly, there are six such ribs. The sheath 26 encases the cables and protects and maintains the same in the described assembled relationship. If the cable 14 is to be fluid cooled, conduits may be provided in the cable through which coolant may pass thus to cool the cable. Conventionally, suitable fittings are provided in the terminal 12** to provide inlets and outlets for the coolant.

Referring again principally to FIG. 5, the terminal end portions of the cable conductors are provided with connector elements 50 and 52 for each cable lead 40 and 42 which provide for the electrical and mechanical connection to the terminal 12 as described below. The connectors 50 are secured, respectively, to the end portions of conductors **40*a* and 42*a* while connectors 52 are secured respectively to the other two conductors 40*b*, 40*c* and 42*b*, 42*c* of each lead. It should be appreciated that the single connectors 50 are diametrically spaced from one another and the double connectors 52 are substantially adjacent yet slightly spaced from one another. Moreover, it should be appreciated that the connectors 50 and 52 of opposite leads are, respectively, essentially of like shape and symmetrically disposed relative to the longitudinal axis of the terminal. For convenience, the connectors of the lead 40 will be described in greater detail below, it of course being understood that such description is equally applicable to the connectors of the lead 42**.

The single conductor terminal connector 50 comprises a tubular member or sheath through which the terminal end portion of the conductor **40*a* extends substantially straight and substantially the entire extent of the connector 50 without the end portion of the conductor 40*a* having to be significantly bent and/or twisted from alignment with the conductor's circumferentially disposed location relative to the other conductors in the cable. The connector 50 has a forward portion 54 and a rearward portion 56. The forward portion 54 is substantially rectangular in cross-section and is formed with a substantially flat contact surface 58 adapted for mating engagement with the contact surface 34 of the extension 32 as seen in FIG. 4. The forward portion 54 also includes a fastener receiving aperture 60 which extends transveresly therethrough, and when aligned with aperture 38 in the surface 34, a clamping screw fastener 62 may extend through aperture 60 and be threadedly received in aperture 38 for removably securing the connector 50 to the extension 32 of the terminal element 16. The rearward portion 56** is formed to receive the cable conductor terminal end portion in substantially the shape as received from the cable and thus with mimimal deformation of the conductor.

The connector 52 similarly comprises a tubular member or sheath through which the terminal end portions of the conductors **40*b* and 40*c* extend, but the connector 52 is of sufficient width such that the end portions of both conductors 40*b* and 40*c* extend substantially straight substantially the entire extent of the connector 52** without the end portions thereof having to be significantly bent and/or twisted from alignment with the conductors' circumferentially disposed location relative to the other conductors in the cable.

Similar to connector 50, the connector 52 has a forward portion 64 and rearward portion 66. The forward portion 64 is substantially rectangular in cross-section and is formed with a substantially flat contact face 68 adapted for mating engagement with the contact surfaces 36 of the extension 32 as seen in FIG. 4. A fastener receiving aperture 70 extends transversely through the forward portion and may receive a fastener 72 which threadedly engages aperture 38 in the surface 36 removably to secure and clamp the connector 52 to the extension 32 of the corresponding terminal half 16. For a purpose which will become more apparent below, the forward portion includes a laterial recess or cut-out 74 adapted to clear the extension 32 of the opposed terminal half 18 without electrical contact therebetween when assembled. The rearward portion 66 is formed with two laterally spaced bosses 76 which are aligned with the cable conductors **40*b* and 40*c* and receive the end portions of the same in substantially the same shape as received from the cable. The connectors 52** are accordingly substantially L-shape in configuration with the parallel cables extending from the shorter thicker leg parallel to the long leg.

In similar fashion, the conductors of the lead 42 may be secured to the terminal element 18. Connector 50 is secured to conductor 42*a* which in turn is removably fastened to the extension 36 of the terminal element 18 at the receiving surface 34. Connector 52 is secured to conductors 42*b* and 42*c* which also are removably secured to the extension 32 of the terminal element 18 but at the receiving surface 36 thereof.

It will of course be appreciated that the cable connectors may be soldered, welded, or brazed, along with, or in lieu of, the clamping fasteners illustrated.

Each of the tubular connectors may be secured to their respective conductor end portion or portions by crimping or swaging or otherwise forming the connector around the end portion or portions. Such swaging or forming forms the strands of the conductor into a tightly bundled mass of conductor material. As the conductors are maintained in the rearward portions substantially in the same shape as received from the cable and are flattened at the forward portion giving the same the generally described rectangular sectional profile, there is some slight bending required to spread the conductors to the flattened shape. However, such slight bending is minor in comparison with the bending and twisting encountered in previously known methods and such bending is fully contained within the conductor connector which prevents any further bending or twisting thereof during flexure of the cable in use. It will also be appreciated that the swaging or forming process is relatively simple and requires inexpensive dies or tools.

As seen in FIG. 4, the forward end portions 58 and 68 of the respective connectors 50 and 52 are secured to the extensions 32 by their respective fasteners 62 and 72, and the connectors 50 and 52 are disposed so that the respective contact surfaces 58 and 68 of each are joined to the respective receiving surfaces 34 and 36 in abutting conductive relationship, and provide sufficiently large contact areas for electrical efficiency of the joint. Of course, the connectors connected to the conductors of the same lead are attached to the same terminal elements as above described. It can be seen that the forward portions 58 and 68 of the respective connectors 50 and 52 of opposite leads 40 and 42 are disposed on opposite sides of a diametrical plane extending longitudinally therebetween, and preferably the terminal elements 16 and 18 are orientated such that their respective inner faces 20 and 22 are substantially parallel with such diametrical plane. Moreover, the insulating plate preferably extends between the forward portions of the connectors of opposite leads as seen in FIG. 1. To assure sufficient clearance with the insulating plate 24 and proper fit, the forward portions of the connectors 50 may be slightly laterally offset from the rearward portions as best seen in FIG. 5 and generally shown at 78. Alternately or concurrently with such offset, the corners of the forward portions of the connectors adjacent the insulator plate 24 may include chamfers or radii also to ensure adequate clearance.

When so secured to the terminal elements, the connectors are maintained in closely packed relationship with connectors corresponding to the opposite leads being diametrically, alternately, spaced apart with such spacing being sufficient to prevent electrical short circuits between connectors of opposite leads. Normally the spacing need not be great as such cable assemblies in welding operations normally carry high currents at low voltages. There may be provided, if desired, insulation between the connectors corresponding to opposite leads.

In order to maintain the connectors closely packed at their respective rearward portions, it can be seen in FIG. 3 that there are provided recesses 80 between the spaced bosses 76 of the rearward portions 66 of the connectors 52 in which nest in spaced relationship the rearward portions 56 of the connectors 50 corresponding to the opposite leads. Preferably, the bosses 76 are somewhat triangular in shape formding therebetween a substantially V-shaped recess 80 which accommodates the relatively inverted, triangularly shaped, rearward portion 56 of the connector 50. It can thus be seen that the connectors when assembled have a combined transverse width which substantially corresponds to the diametric width of the cable 14. Accordingly, the sheath 26 will readily fit over the connectors to permit securing of the sheath to the terminal 12.

Because bending stresses may occur in the strands at the area directly adjacent the relatively unyielding connectors 50 and 52, a plastic sleeve 82 is fastened over each conductor with the forward end of each sleeve being secured in the boss or rearward portion of the corresponding connector to reduce the stresses in this area as would otherwise occur during flexure of the cable. The sleeve preferably extends a sufficient distance along the conductor and provides sufficient rigidity to the conductors so as to increase the radius of curvature of the strand while it is being bent so that the conductors are not subjected to high localized bending stresses. These sleeves 82 may be inserted over the ends of the conductors with a portion of the conductor projecting therebeyond, and the preshaped connector may be swaged or crimped to its desired profile in turn securing the cable conductor and sleeve in place. It will also be appreciated that the sleeve electrically insulates the conductors of opposite leads in the event the insulating member does not extend fully to the connectors.

There is accordingly provided an opposite polarity "kickless" cable which includes mutually insulated semi-circular lugs 16 and 18, each having a flattened projection 32 at its inner end, each providing recessed parallel flat conductor connecting surfaces 34 and 36 which are symmetrically respectively diametrically offset, so that the plane of one surface is radially offset from the plane of the circumjacent surface of the other projection. In this manner, the simplified L-shape two cable connector 52 may be employed on the one surface of one projection while the essentially straight single cable connector 50 is employed on the radially outwardly and circumferentially offset adjacent surface of the other projection, to connect the cables in the alternating nesting fashion shown.

The terminal connection of the present invention is in this manner easy to fabricate and assemble while providing a long service life.

The embodiments of the invention in which an exclusive property or privilege is claimed are defined as follows:

1. A cable terminal assembly comprising, a terminal including two mutually insulated terminal lug elements, a cable including two mutually insulated leads, each lead including three conductors spaced alternately and circumferentially with the conductors of the other lead, said cable having a terminal end formed of substantially straight end portions of said conductors longitudinally in alignment with the respective conductors' relative positions in which they are located in the cable adjacent said terminal end, first connector means secured to two of said conductors of each lead at said end portions and second connector means secured to the other one of said conductors of each lead, and means for securing said connector means corresponding to one lead to one of said terminal lug elements and said connector means corresponding to the other lead to the other terminal lug element, said connector means of each lead being alternately spaced with those of the other lead.

2. An assembly as set forth in claim 1 wherein said connector means are removably secured to said terminal lug elements.

3. A cable terminal assembly comprising, a terminal including two mutually insulated terminal lug elements, a cable including two mutually insulated leads, each lead including three conductors spaced alternately and circumferentially with the conductors of the other lead, said cable having a terminal end formed of substantially straight end portions of said conductors longitudinally in alignment with the respective conductors' relative positions in which they are located in the cable adjacent said terminal end, plural connector means secured to said conductors of each lead at said end portions, and means for securing said connector means corresponding to one lead to one of said terminal lug elements and said connector means corresponding to the other lead to the other terminal lug element.

4. An assembly as set forth in claim 3 wherein a pair of first connectors each are secured respectively to one of said conductors of each lead, said one of said conductors of each lead being diametrically opposed to the other, and a pair of second connectors each secured respectively to the other two conductors of each lead.

5. An assembly as set forth in claim 4 wherein said connectors are tubular and said end portions of said conductors are received therein and extend substantially the length of said connectors.

6. An assembly as set forth in claim 5 wherein said first and second connectors are diametrically spaced apart with the connectors corresponding to opposite leads being alternately circumferentially arranged.

7. An assembly as set forth in claim 4 wherein said terminal lug elements each include a rearward extension having opposed connector receiving faces.

8. An assembly as set forth in claim 7 wherein each connector includes a forward portion having a contact face for engagement with a corresponding receiving face of said extensions.

9. An assembly as set forth in claim 8 wherein said connectors are secured to said extensions by removable fasteners.

10. An assembly as set forth in claim 8 wherein said second connectors of each lead are substantially L-shape and accommodate, respectively, the extensions corresponding to the opposite lead.

11. An assembly as set forth in claim 8 wherein said receiving and contact faces are substantially planar and parallel.

12. An assembly as set forth in claim 8 wherein said terminal lug elements are of semi-cylindrical shape having their respective planar faces interfacing, and an insulating plate disposed between said terminal elements at said planar faces for insulating said terminal elements from one another.

13. An assembly as set forth in claim 12 wherein said forward portions of said connectors of each lead are disposed on opposite sides of a diametrical plane through said terminal.

14. An assembly as set forth in claim 13 wherein sad diametrical plane and insulating plate are co-planar.

15. An assembly as set forth in claim 8 wherein said second connectors each include a pair of spaced bosses which maintain the conductor in substantially the same shape as received from the cable.

16. An assembly as set forth in claim 15 wherein said first connectors each include a rearward portion which maintains the conductor in substantially the same shape as received from the cable, said second connectors having a recesss between said bosses for accommodating said rearward portion of said first connectors of the opposite lead in closely spaced relationship.

17. An assembly as set forth in claim 8 further comprising a flexible plastic sleeve for each conductor having a rigidly greater than that of said conductor, one end of said sleeve received in the connector for said conductor and the other end extending from said connector along said conductor.

18. A cable terminal comprising a pair of semi-circular terminal lugs mutally insulated along a diameter, each lug having a flattened projection at one end, each projection being offset from each other along the diameter of insulation, and each projection providing recessed substantially parallel flat conductor connecting surfaces.

19. A cable terminal comprising a pair of mutually insulated terminal lugs each having a flattened projection at its inner end, each projection providing recessed parallel flat conductor connecting surfaces, one projection being diametrically offset from the other and an L-shape dual conductor connector connected to the inwardly offset surface and a single conductor connector connected to the outwardly offset surface with the single conductor nested between the conductors of the former.

20. A terminal as set forth in claim 19 wherein each conductor is crimped by said connectors, each connector including a flattened connecting surface.

21. A terminal as set forth in claim 19, wherein said L-shape connector includes a short leg and a long leg, the latter being flattened for connection to said inwardly offset surface.

22. A terminal as set forth in claim 21 wherein two conductors are crimped parallel to each other in the short leg of the L.

23. A terminal as set forth in claim 22 wherein such parallel conductors are formed into a substantially triangular configuration when crimped so that the short leg of the L has a radially outwardly extending V notch therein between said conductors.

24. A terminal as set forth in claim 23 wherein said single conductor connector includes a crimped portion forming the conductor and the connector into a substantially triangular configuration to nest within such V notch.

25. The assembly of claim 2 wherein said first connector means is L-shape.

26. The assembly of claim 2 wherein said first connector means is secured at one end thereof to said conductors and at its other end to its respective lug element, and said connector at said other end is recessed to accommodate the other lug element.

27. The terminal of claim 18 wherein said connecting surfaces extend at a common oblique angle to the diameter of insulation.

28. The terminal of claim 27 wherein said projections include bores opening to said connecting surfaces for receipt of fasteners therein.

29. The terminal of claim 27 wherein said connecting surfaces of each projection are alternately spaced along the diameter of insulation with those of the other.

30. The terminal of claim 29 wherein one connecting surface of each projection has an included acute angle with the diameter of insulation and the other connecting surface has an included obtuse angle, and said one connecting surface of each projection is radially inwardly spaced along the diameter of insulation from said other connecting surface of the other projection.

* * * * *